US009220339B1

(12) United States Patent
Chen

(10) Patent No.: US 9,220,339 B1
(45) Date of Patent: Dec. 29, 2015

(54) BALL STORAGE RACK STRUCTURE

(71) Applicant: Benjamin Chen, Taichung (TW)

(72) Inventor: Benjamin Chen, Taichung (TW)

( * ) Notice: Subject to any disclaimer, the term of this patent is extended or adjusted under 35 U.S.C. 154(b) by 0 days.

(21) Appl. No.: 14/483,201

(22) Filed: Sep. 11, 2014

(51) Int. Cl.
*A47F 7/00* (2006.01)
*A47B 43/00* (2006.01)
*A47B 81/00* (2006.01)

(52) U.S. Cl.
CPC ..... *A47B 43/00* (2013.01); *A47B 81/00* (2013.01)

(58) Field of Classification Search
CPC .. A47B 43/00; A47B 81/00; A47B 2013/026; A47B 2200/0032; A47B 2200/0011; A47B 13/02; A47B 3/12; A63B 47/00; B65D 90/12; B65D 90/14; B65D 90/143; B65D 90/146; F16M 11/32; F16M 11/34; D06F 57/08; Y10T 403/32631; A47C 9/105; A47C 9/04
USPC ..... 211/182, 14, 13.1, 198, 203; 248/121, 248/127, 146, 151, 370, 158, 160, 163.1, 248/163.2, 164, 431, 432, 165, 440, 440.1, 248/176.1, 188.1, 168, 169, 170, 171, 248/188.6, 188.7; 220/508; 206/315.9; 403/217, 218
See application file for complete search history.

(56) References Cited

U.S. PATENT DOCUMENTS

| | | | | | |
|---|---|---|---|---|---|
| 509,005 | A * | 11/1893 | Voeltzkow | 248/431 |
| 664,976 | A * | 1/1901 | Sheffy et al. | 248/431 |
| 1,022,862 | A * | 4/1912 | McMillen | 119/69 |
| 1,172,439 | A * | 2/1916 | Crozier | 297/461 |
| 1,371,263 | A * | 3/1921 | Reed | 248/150 |
| 2,368,740 | A * | 2/1945 | Blomgren | 108/154 |
| 2,710,733 | A * | 6/1955 | Phillips | 248/431 |
| 2,841,352 | A * | 7/1958 | Pappas | 108/157.18 |
| 3,267,889 | A * | 8/1966 | Bedol | 108/157.15 |
| 3,309,055 | A * | 3/1967 | Sefcik | 248/431 |
| 3,312,438 | A * | 4/1967 | Goetz et al. | 248/165 |
| 4,319,729 | A * | 3/1982 | Lo | 248/188.7 |
| 4,423,849 | A * | 1/1984 | Jordan | 248/165 |
| 5,029,795 | A * | 7/1991 | Dexter | 248/431 |
| 5,044,507 | A * | 9/1991 | Shulyak | 211/203 |
| 6,398,040 | B1 * | 6/2002 | Gregory | 211/14 |
| 8,882,135 | B1 * | 11/2014 | Chen | 280/651 |
| 2008/0185805 | A1 | 8/2008 | Chen | |
| 2013/0026313 | A1 * | 1/2013 | Morrow | 248/157 |

FOREIGN PATENT DOCUMENTS

| | | |
|---|---|---|
| TW | M315046 U | 7/2007 |

* cited by examiner

*Primary Examiner* — Jennifer E Novosad
(74) *Attorney, Agent, or Firm* — Alan D. Kamrath; Kamrath IP Lawfirm, P.A.

(57) ABSTRACT

A ball storage rack structure includes: a base member having first pivotal portions and first and second abutting portions; support rods abutting against the first abutting portions, crossing each other radially, and each having a second pivotal portion and first and second coupling portions, with the second pivotal portions connected pivotally to the first pivotal portions; a bag having third coupling portions coupled to the second coupling portions such that the bag is mounted on the support rods; and a cord having fourth coupling portions coupled to the first coupling portions, underpinning the bag. The weight of the bag is borne by the second coupling portions and the cord, and the cord is pulled by a user to drive the support rods to rotate about the first pivotal portions and abut against the second abutting portions. Pivotal elements connect pivotally the first pivotal portions to the second pivotal portions.

20 Claims, 7 Drawing Sheets

BALL STORAGE RACK STRUCTURE

BACKGROUND OF THE INVENTION

1. Technical Field

The present invention relates to ball storage rack structures and, more particularly, to a ball storage rack structure with a base member and a cord. The base member has a plurality of first abutting portions. The first abutting portions enable a plurality of support rods to cross each other in a radiating manner. The cord is operable by a user to control the support rods and bear the weight of a bag. Hence, the ball storage rack structure of the present invention features enhanced ease of use and enhanced practicability.

2. Description of Related Art

A conventional ball storage rack is disclosed in US2008/0185805A1 and TW 096200763 entitled Ball Storage Rack. The ball storage rack comprises: at least three support rods arranged in an array, with the support rods each having a ground end equipped with a roller; two base members each having a pivot pivotally coupled thereto, with the quantity of the pivots pivotally coupled to each base member being the same as that of the support rods, with the base members positioned between the support rods in an axial direction of the support rods, with the pivots pivotally coupled to the support rods, respectively; and a connecting member with two ends connected to the two base members, respectively, such that the two base members are connected in an interactive manner.

The prior art has drawbacks as follows:

1. The ball storage rack structure of US2008/0185805A1 has at least three main rods, two base members, and at least six pivots. Hence, a plethora of constituent elements of the ball storage rack structure adds to the costs of the ball storage rack structure greatly.

2. Referring to FIG. 3 of US2008/0185805A1, a ball bag is usually mounted on the main rods, and the ball bag holds a plurality of balls. The support rods as a whole collapse as soon as the ball storage rack structure falls, thereby allowing the balls to escape from the ball bag. In the aftermath of the accident, a user has to erect the support rods and pick the balls. Hence, the ball storage rack structure lacks ease of use.

SUMMARY OF THE INVENTION

One of the drawbacks of the prior art is that a conventional ball storage rack consists of too many elements and thus incurs high costs. By contrast, a ball storage rack structure of the present invention comprises a base member and a cord. The base member has a plurality of first abutting portions. The first abutting portions enable a plurality of support rods to cross each other in a radiating manner. The cord is operable by a user to control the support rods and bear the weight of a bag. Hence, the ball storage rack structure of the present invention has less constituent elements than its conventional counterpart.

To overcome the aforesaid drawback of the prior art, the present invention provides a ball storage rack structure which comprises a base member having a plurality of first pivotal portions, a plurality of first abutting portions, and a plurality of second abutting portions. A plurality of support rods abut against the first abutting portions, respectively, with the support rods crossing each other in a radiating manner, and with the support rods each having a second pivotal portion. The second pivotal portions are coupled to the first pivotal portions, respectively, with the support rods each having a first coupling portion and a second coupling portion. A bag has a plurality of third coupling portions coupled to and engaged with the second coupling portions, respectively. Thus, the bag is mounted on the support rods. A cord has a plurality of fourth coupling portions coupled to the first coupling portions, respectively. The cord is in contact with the bottom of the bag, such that the weight of the bag is borne by the second coupling portions of the support rods and the cord. The cord can be pulled by a user to drive the support rods to rotate about the first pivotal portions and abut against the second abutting portions, respectively. A plurality of pivotal elements connects pivotally the first pivotal portions to the second pivotal portions, respectively.

As compared to the prior art, the ball storage rack structure of the present invention essentially requires a base member and at least three support rods. The support rods abut against the first abutting portions, respectively. The support rods cross each other in a radiating manner. Hence, not only does the ball storage rack structure of the present invention stand firmly on the ground, but the components and costs of the ball storage rack structure of the present invention are also reduced. The cord has the fourth coupling portions. The fourth coupling portions are coupled to the first coupling portions of the support rods, respectively. The cord is in contact with the bottom of the bag. The total weight of the bag and the balls contained therein is borne by the second coupling portions of the support rods and the cord. The cord spreads the total weight of the bag to therefore overcome a drawback of the prior art—a portion of each support rod is near a corresponding one of the second coupling portions, and the portion of each support rod bends whenever the bag contains too many balls. The cord is pulled by the user to drive the support rods to rotate about the first pivotal portions of the base member and abut against the second abutting portions of the base member, respectively, to collapse the support rods as a whole. Since the user can drive the support rods by pulling the cord, the support rods as a whole can be collapsed conveniently and precisely.

DETAILED DESCRIPTION OF THE EMBODIMENTS OF THE INVENTION

Figure 1:
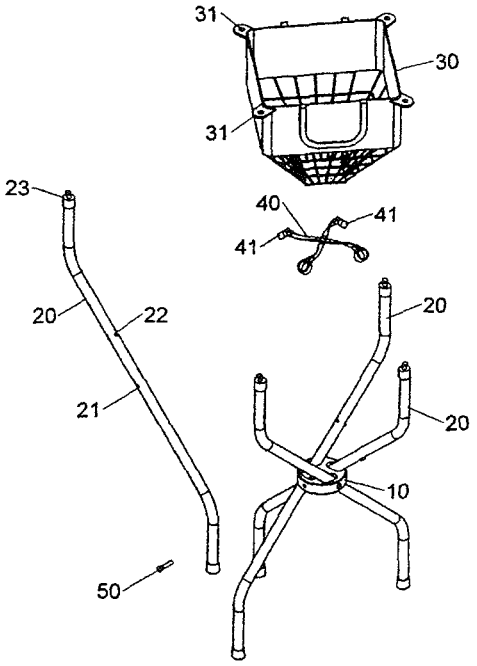
FIG. 1 is an exploded view of a ball storage rack structure of the present invention.
Figure 2:
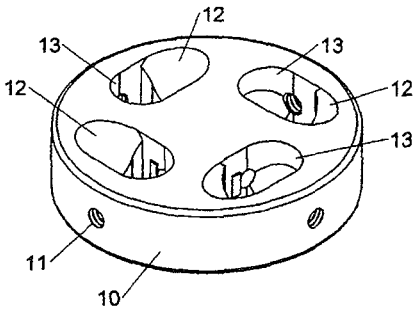
FIG. 2 is a perspective view of a base member of the ball storage rack structure of the present invention.
Figure 3:
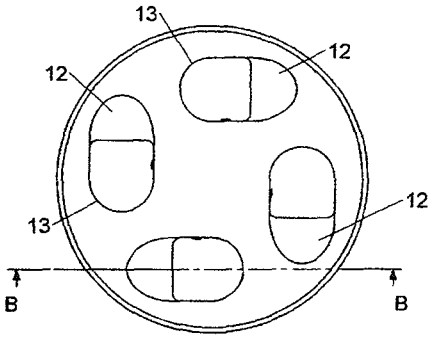
FIG. 3 is a top view of the base member of the ball storage rack structure of the present invention.
Figure 4:
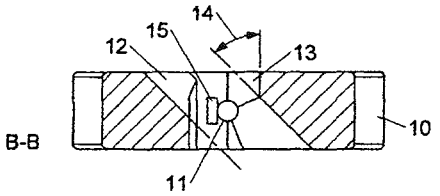
FIG. 4 is a cross-sectional view of the base member taken along line B-B of FIG. 3 according to the present invention.

Referring to FIG. 1 through FIG. 4, there are shown in FIG. 1 an exploded view of a ball storage rack structure of the present invention, in FIG. 2 a perspective view of a base member of the ball storage rack structure of the present invention, in FIG. 3 a top view of the base member of the ball storage rack structure of the present invention, and in FIG. 4 a cross-sectional view of the base member taken along line B-B of FIG. 3 according to the present invention. The present invention relates to a ball storage rack structure. The ball storage rack structure, which holds balls, comprises a base member 10, a plurality of support rods 20, a bag 30, a cord 40, and a plurality of pivotal elements 50.

Referring to FIG. 2 through FIG. 4, the base member 10 has a plurality of first pivotal portions 11. The first pivotal portions 11 are in the number of at least three. Preferably, the first pivotal portions 11 are in the number of four. The first pivotal portions 11 are circumferentially arranged on the outer circumferential surface of the base member 10. The first pivotal portions 11 each have an internal thread positioned proximate to the outer circumferential surface of the base member 10. The base member 10 has a plurality of first abutting portions 12. The first abutting portions 12 are in communication with the first pivotal portions 11, respectively. The first abutting portions 12 are each a penetrable oblique opening. The first abutting portions 12 are in the same number as the first pivotal portions 11. The first abutting portions 12 are in the number of four. Each first abutting portion 12 extends to form a second abutting portion 13. The second abutting portions 13 are each in communication with a corresponding one of the first abutting portions 12 and a corresponding one of the first pivotal portions 11. The second abutting portions 13 are each an upright opening. The second abutting portions 13 are in the number of four. The first abutting portions 12 are each an oblique opening defined by a first angle 14. The first angle 14 ranges from 30° to 60° and is preferably 45°. A first raised portion 15 is disposed between the first abutting portion 12 and the second abutting portion 13 and positioned proximate to the first pivotal portion 11.

The support rods 20 are in the same number as the first pivotal portions 11 of the base member 10. The support rods 20 are in the number of four. The support rods 20 abut against the first abutting portions 12 of the base member 10, respectively. The support rods 20 cross each other in a radiating manner. The support rods 20 rest firmly on a plane or the ground. The support rods 20 each have a second pivotal portion 21. The second pivotal portion 21 faces and matches a corresponding one of the first pivotal portions 11. The second pivotal portions 21 are pivotally connected to the first pivotal portions 11, respectively, such that the support rods 20 each rotate about a corresponding one of the first pivotal portions 11. The second pivotal portions 21 are each a through round hole. The support rods 20 each have a first coupling portion 22. The first coupling portion 22 is above the second pivotal portion 21. The first coupling portions 22 are each a through round hole. A second coupling portion 23 is disposed at the top end of each support rod 20. Regarding each support rod 20, the first coupling portion 22 is disposed between the second coupling portion 23 and the second pivotal portion 21. The second coupling portion 23 has a hook structure. The support rods 20 are each slender, substantially S-shaped lengthwise, and round in cross-section.

The bag 30 holds therein balls. The bag 30 has a plurality of third coupling portions 31. The third coupling portions 31 of the bag 30 are coupled to and engaged with the second coupling portions 23 of the support rods 20, respectively, such that the bag 30 is mounted on the support rods 20. The third coupling portions 31 of the bag 30 are in the same number as the second coupling portions 23 of the support rods 20. The third coupling portions 31 are in the number of four. The bag 30 is a netlike bag structure.

The cord 40 has a plurality of fourth coupling portions 41. The fourth coupling portions 41 of the cord 40 are coupled to the first coupling portions 22 of the support rods 20, respectively. The cord 40 is in contact with the bottom of the bag 30, such that the cord 40 and the second coupling portions 23 of the support rods 20 together bear the weight of the bag 30. The cord 40 can be pulled by a user to drive the support rods 20 to rotate about the first pivotal portions 11 of the base member 10, and thus the support rods 20 are confined to and abut against the second abutting portions 13 of the base member 10, respectively, such that the support rods 20 as a whole collapse. When the support rods 20 are in the number of four, the cord 40 is in a form of a cruciform structure. The cord 40 is made of a durable material, such as plastic or nylon.

The pivotal elements 50 connect pivotally the first pivotal portions 11 of the base member 10 to the second pivotal portions 21 of the support rods 20, respectively. The pivotal elements 50 are in the same number as the first pivotal portions 11 of the base member 10. The pivotal elements 50 are in the number of four. The pivotal elements 50 each have a thread portion. The thread portion is an external thread, such that the pivotal elements 50 are screwed to the first pivotal portions 11, respectively.

Figure 5:
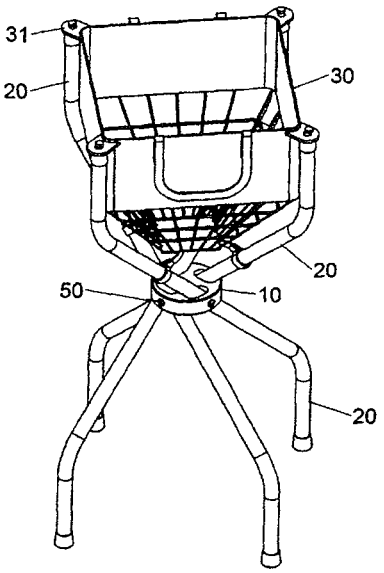
FIG. 5 is an assembled perspective view of the ball storage rack structure of the present invention.
Figure 6:
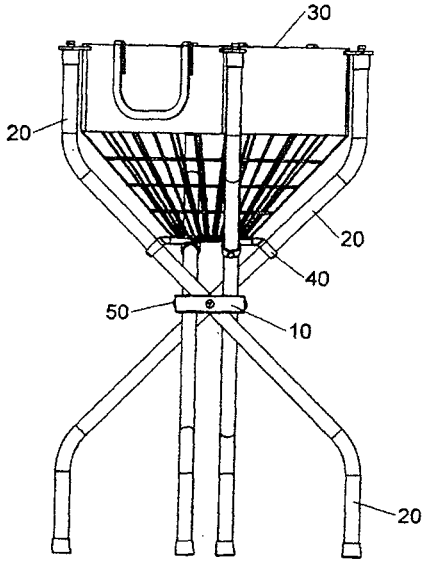
FIG. 6 is a side view of the ball storage rack structure of the present invention.

Referring to FIG. 5 and FIG. 6, there are shown in FIG. 5 an assembled perspective view of the ball storage rack structure of the present invention, and in FIG. 6 a side view of the ball storage rack structure of the present invention. Referring to the diagrams, the first pivotal portions 11 of the base member 10 connect pivotally to the second pivotal portions 21 of the support rods 20, respectively. The support rods 20 abut against the first abutting portions 12 of the base member 10, respectively. The support rods 20 cross each other in a radiating manner. The second coupling portions 23 of the support rods 20 are coupled to and engage with the third coupling portions 31 of the bag 30, respectively, such that the bag 30 is mounted on the support rods 20. The first coupling portions 22 of the support rods 20 are coupled to the fourth coupling portions 41 of the cord 40, respectively, such that the bag 30 is mounted on the cord 40, allowing the cord 40 and the support rods 20 to underpin the bag 30. The pivotal elements 50 connect pivotally the first pivotal portions 11 of the base member 10 to the second pivotal portions 21 of the support rods 20, respectively.

Figure 7:
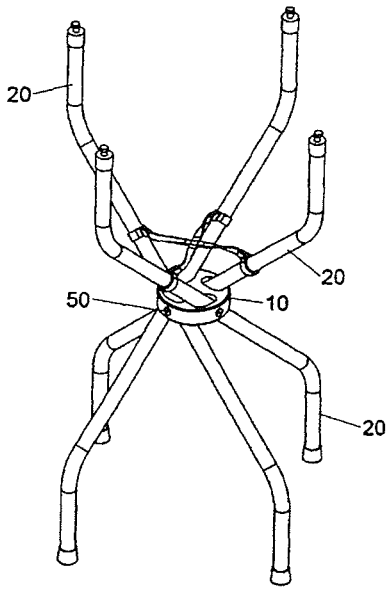
FIG. 7 is a schematic view of the first operation of the ball storage rack structure of the present invention.

Referring to FIG. 7, there is shown a schematic view of the first operation of the ball storage rack structure of the present invention. As shown in the diagram, to stop using the ball storage rack structure of the present invention, the user separates the second coupling portions 23 of the support rods 20 from the third coupling portions 31 of the bag 30, respectively, and then dismounts the bag 30.

Figure 8:
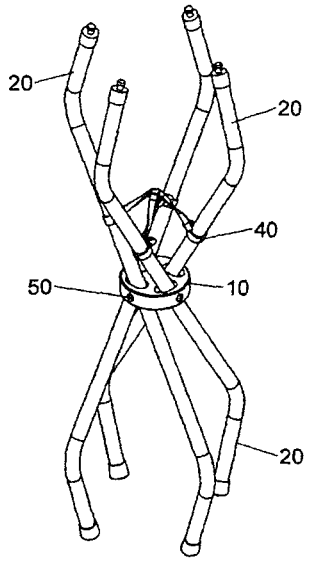
FIG. 8 is a schematic view of the second operation of the ball storage rack structure of the present invention.

Referring to FIG. 8, there is shown a schematic view of the second operation of the ball storage rack structure of the present invention. As shown in the diagram, the cord 40 can be pulled by the user to control the support rods 20. When the user pulls the cord 40 upward, the support rods 20 rotate about the first pivotal portions 11 of the base member 10, respectively, and the support rods 20 undergo displacement from the first abutting portions 12 to the second abutting portions 13, respectively.

Figure 9:
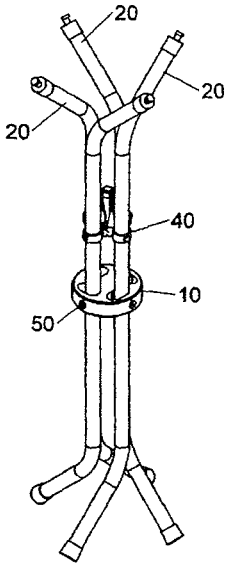
FIG. 9 is a schematic view of the third operation of the ball storage rack structure of the present invention.

Referring to FIG. 9, there is shown a schematic view of the third operation of the ball storage rack structure of the present invention. Referring to the diagram, when the ball storage rack structure of the present invention collapses, the support rods 20 abut against the second abutting portions 13 of the base member 10, respectively. Since the second abutting portions 13 are upright openings, the slender support rods 20 are parallel. The support rods 20 are engaged with the first raised portions 15 in the second abutting portions 13, respectively. Since the support rods 20 are confined to the first raised portions 15, the support rods 20 cannot move back to the first abutting portions 12. Hence, the ball storage rack structure stands firmly and is collapsible.

Figure 10:
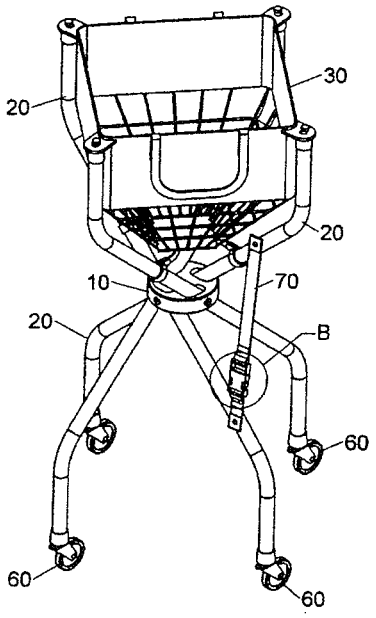
FIG. 10 is a perspective view of the ball storage rack structure according to the second embodiment of the present invention.
Figure 11:
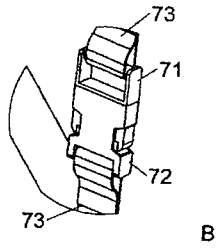
FIG. 11 is an enlarged view of portion B in FIG. 10 according to the present invention.

Referring to FIG. 10 and FIG. 11, there are shown in FIG. 10 a perspective view of the ball storage rack structure according to the second embodiment of the present invention, and in FIG. 11 an enlarged view of portion B in FIG. 10 according to the present invention. In this embodiment, as shown in the diagrams, the ball storage rack structure further comprises a plurality of rollers 60 and at least a snap-engagement unit 70. The rollers 60 are disposed at the bottom ends of the support rods 20, respectively, such that the ball storage rack structure can be easily moved because of the rollers 60. The snap-engagement unit 70 has one end fixed to one of the support rods 20. The other end of the snap-engagement unit 70 is fixed to another adjacent support rod 20. The two ends of the snap-engagement unit 70 are above and below the first pivotal portions 11 of the base member 10, respectively. If the ball storage rack structure of the present invention falls, the snap-engagement unit 70 will keep the support rods 20 stretching, such that the stability of the ball storage rack structure of the present invention will remain unabated. The snap-engagement unit 70 is a male-female engaging structure. The snap-engagement unit 70 has a male engaging portion 71 and a female engaging portion 72. The male engaging portion 71 and the female engaging portion 72 are coupled to and engaged with each other, whereas the free end of the male engaging portion 71 and the free end of the female engaging portion 72 are connected to the support rods 20, respectively, through a fixing cord 73 each. The sum of the length of the male engaging portion 71 and the length of the fixing cord 73 thereof is larger than the sum of the length of the female engaging portion 72 and the length of the fixing cord 73 thereof.

Figure 12:
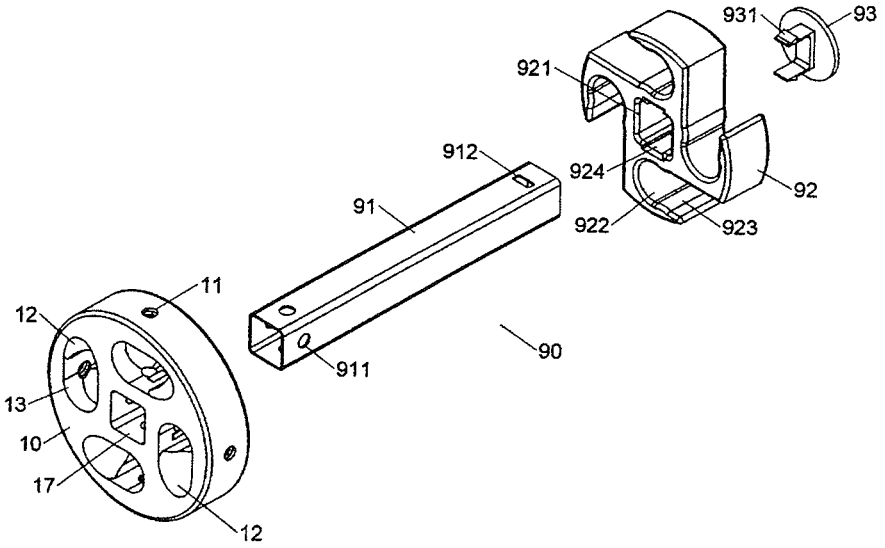
FIG. 12 is an exploded view of the base member and a fixing assembly of the ball storage rack structure according to the third embodiment of the present invention.

Referring to FIG. 12, there is shown an exploded view of the base member 10 and a fixing assembly 90 of the ball storage rack structure according to the third embodiment of the present invention. In this embodiment, a first fitting portion 17 is disposed centrally at the base member 10. The first fitting portion 17 is penetrable and not round in cross-section. Preferably, the first fitting portion 17 is quadrilateral in cross-section. The first fitting portion 17 is in communication with the first pivotal portions 11 and is penetrable by the fixing assembly 90. The fixing assembly 90 comprises a fixing bar 91, a fixing unit 92, and an engaging unit 93.

The fixing bar 91 corresponds in shape to the first fitting portion 17 of the base member 10. The fixing bar 91 has a quadrilateral cross-section. A first coupling hole 911 is disposed at one end of the fixing bar 91. The first coupling hole 911 matches and faces a corresponding one of the first pivotal portions 11 of the base member 10. The pivotal elements 50 pass through the first pivotal portions 11, respectively, and thus are confined to the first coupling hole 911, such that the fixing bar 91 is coupled to the base member 10. The first coupling hole 911 is a through round hole. A plurality of engaging slots 912 is disposed at the other end of the fixing bar 91. The engaging slots 912 are in the number of two. The engaging slots 912 are disposed on two opposing sides of the fixing bar 91, respectively. The engaging slots 912 are penetrable and oblong. The fixing bar 91 is slender and has a hollow core.

The fixing unit 92 is coupled to the other end of the fixing bar 91. A second fitting portion 921 is disposed centrally at the fixing unit 92. The second fitting portion 921 is of the same shape as the fixing bar 91. The fixing unit 92 has a plurality of receiving members 922. Each receiving member 922 is of the same width as each support rod 20. The support rods 20 are confined to the receiving members 922, respectively. The receiving members 922 each have a second raised portion 923 positioned proximate to an opening of the receiving member 922. The second raised portions 923 are engaged with the support rods 20, respectively, thereby preventing the support rods 20 from escaping from the receiving members 922. Two recesses 924 are disposed on two opposing sides of the second fitting portion 921, respectively. The recesses 924 each match and face a corresponding one of the engaging slots 912 of the fixing bar 91. The fixing unit 92 has a substantially swastika shape.

At least one engaging portion 931 is protrudingly disposed on the engaging unit 93. Preferably, the at least one engaging portion 931 is in the number of two. The engaging portions 931 fit inside the fixing bar 91 and thus are coupled to and engaged with the engaging slots 912 of the fixing bar 91, respectively. The engaging portions 931 are engaged with the bottoms of the recesses 924 of the fixing unit 92, respectively, such that the engaging unit 93 enables the fixing bar 91 and the fixing unit 92 to be coupled to each other.

Figure 13:
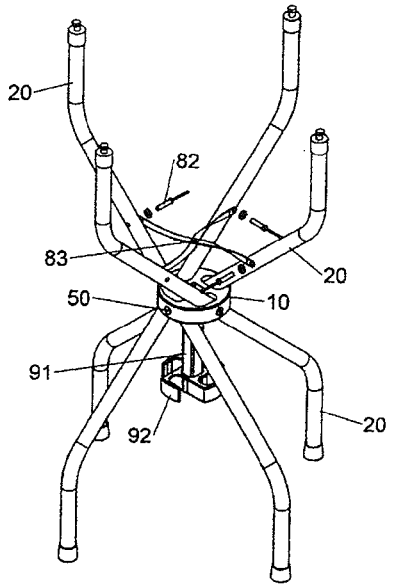
FIG. 13 is a perspective view of the ball storage rack structure according to the third embodiment of the present invention.

Referring to FIG. 13, there is shown a perspective view of the ball storage rack structure according to the third embodiment of the present invention. In this embodiment, as shown in the diagram, a plurality of blind rivet structures 82 and an eyelet rivet structure 83 are provided. Due to the blind rivet structures 82, the fourth coupling portions 41 of the cord 40 are coupled to the first coupling portions 22 of the support rods 20, respectively. The blind rivet structures 82 are in the number of four. The cord 40 consists substantially of two slender cord-like elements which cross each other to render the cord 40 in a form of a cruciform structure. An eyelet rivet structure 83 is disposed at the central junction of the cruciform structure of the cord 40. The pivotal elements 50 pass through the first pivotal portions 11 of the base member 10, respectively, and thus are confined to the first coupling hole 911 of the fixing bar 91, such that the fixing assembly 90 is mounted on the base member 10 from below. When the ball storage rack structure of the present invention collapses, the support rods 20 are confined to the receiving members 922 of the fixing unit 92, respectively, and the support rods 20 are engaged with the second raised portions 923, respectively, to thereby prevent the support rods 20 from escaping from the receiving members 922. Therefore, the ball storage rack structure of the present invention collapses steadily, efficiently, and easily.

Figure 14:
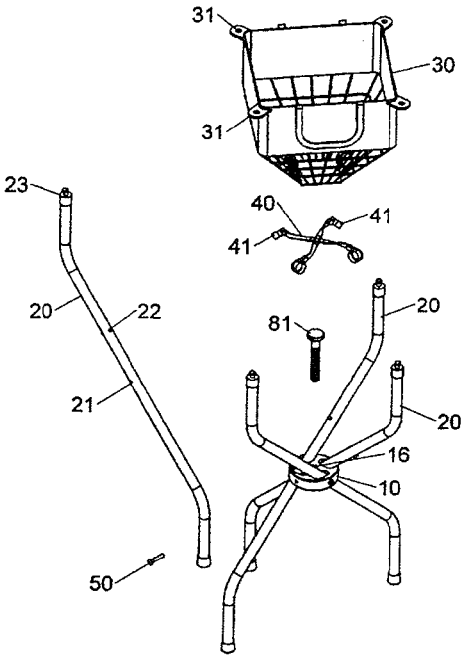
FIG. 14 is an exploded view of the ball storage rack structure according to the fourth embodiment of the present invention.
Figure 15:
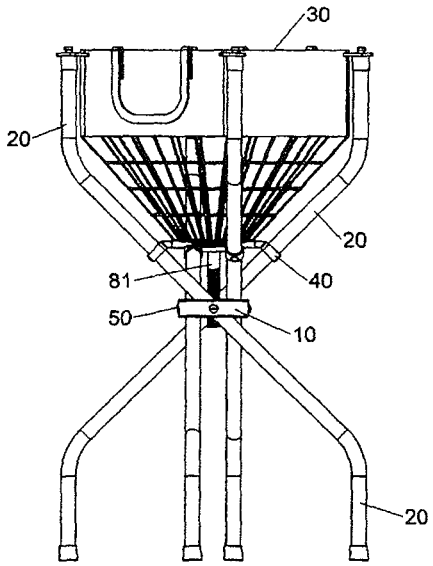
FIG. 15 is a side view of the ball storage rack structure according to the fourth embodiment of the present invention.

Referring to FIG. 14 and FIG. 15, there are shown in FIG. 14 an exploded view of the ball storage rack structure according to the fourth embodiment of the present invention, and in FIG. 15 a side view of the ball storage rack structure according to the fourth embodiment of the present invention. In this embodiment, as shown in the diagrams, a penetrable screwing hole 16 is disposed centrally at the base member 10 and has an internal thread. In the fourth embodiment, the ball storage rack structure further comprises a support element 81. A screwing portion is disposed at one end of the support element 81. The screwing portion has an external thread. The screwing portion meshes with the screwing hole 16. The support element 81 underpins the cord 40. The weight of the bag 30 is borne by the support rods 20, the cord 40, and the support element 81. Therefore, the ball storage rack structure of the present invention demonstrates enhanced stability.

Figure 16:
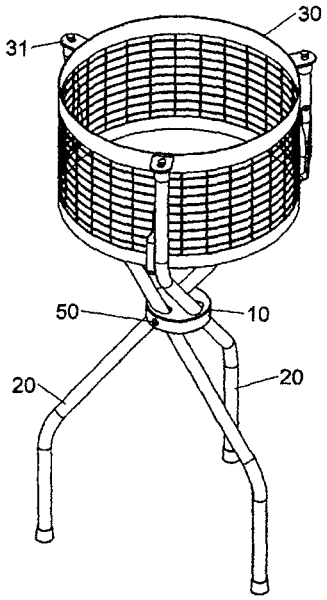
FIG. 16 is a perspective view of the ball storage rack structure according to the fifth embodiment of the present invention.

Referring to FIG. 16, there is shown a perspective view of the ball storage rack structure according to the fifth embodiment of the present invention. In this embodiment, as shown in the diagram, the base member 10 has three first pivotal portions 11. Thus, the support rods 20 are in the number of three, whereas the bag 30 looks spherical.

Figure 17:
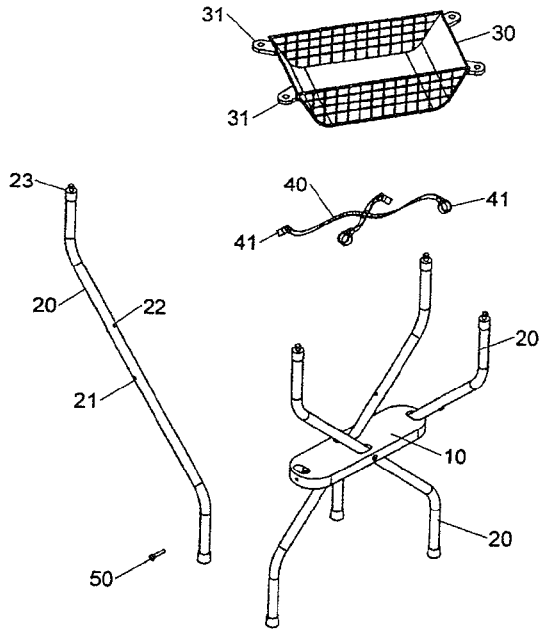
FIG. 17 is an exploded view of the ball storage rack structure according to the sixth embodiment of the present invention.
Figure 18:
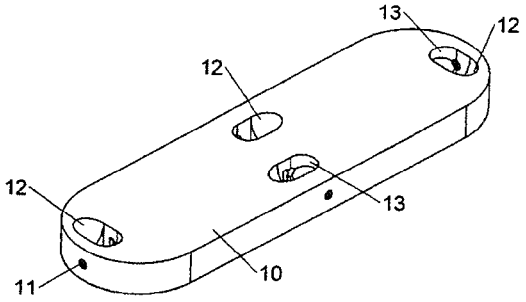
FIG. 18 is a perspective view of the base member of the ball storage rack structure according to the sixth embodiment of the present invention.
Figure 19:
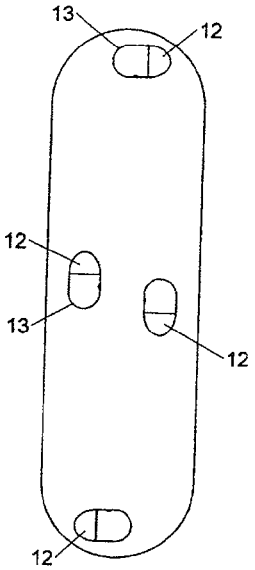
FIG. 19 is a top view of the base member of the ball storage rack structure according to the sixth embodiment of the present invention.

Referring to FIG. 17 through FIG. 19, there are shown in FIG. 17 an exploded view of the ball storage rack structure according to the sixth embodiment of the present invention, in FIG. 18 a perspective view of the base member 10 of the ball storage rack structure according to the sixth embodiment of the present invention, and in FIG. 19 a top view of the base member 10 of the ball storage rack structure according to the sixth embodiment of the present invention. In this embodiment, as shown in the diagrams, the base member 10 is slender, and the cord 40 is longer, such that the receiving space of the bag 30 is enlarged to therefore contain more balls.

The advantages of the ball storage rack structure of the present invention are as follows:

1. The ball storage rack structure of the present invention essentially requires a base member 10 and at least three support rods 20. Each support rod 20 and a corresponding one of the first abutting portions 12 abuts against each other. The support rods 20 cross each other in a radiating manner. Hence, the ball storage rack structure of the present invention rests firmly on the ground, thereby reducing the required constituent elements and costs of the ball storage rack structure of the present invention.
2. Referring to FIG. 5 and FIG. 6, the cord 40 has the fourth coupling portions 41, and the fourth coupling portions 41 are coupled to the first coupling portions 22 of the support rods 20, respectively. The cord 40 is in contact with the bottom of the bag 30. The total weight of the bag 30 and the balls contained therein is borne by the second coupling portions 23 of the support rods 20 and the cord 40. The cord 40 spreads the total weight of the bag 30 to therefore overcome a drawback of the prior art—a portion of each support rod 20 is near a corresponding one of the second coupling portions 23, and the portion of each support rod 20 bends whenever the bag 30 contains too many balls.
3. Referring to FIG. 7, FIG. 8 and FIG. 9, the cord 40 can be pulled by the user to drive the support rods 20 to rotate about the first pivotal portions 11 of the base member 10, respectively, and abut against the second abutting portions 13, respectively, thereby collapsing the support rods 20 as a whole. It is easy to collapse the support rods 20 simply by pulling the cord 40.
4. Referring to FIG. 10, the snap-engagement unit 70 is a male-female engaging structure and is disposed on the same side of different support rods 20. If the ball storage rack structure of the present invention falls, the snap-engagement unit 70 will keep the support rods 20 stretching, such that the stability of the ball storage rack structure of the present invention will remain unabated.

What is claimed is:

1. A ball storage rack structure, for holding a plurality of balls, comprising:

a base member having a plurality of first pivotal portions and a plurality of first abutting portions, with the plurality of first pivotal portions in a number of at least three, with the plurality of first abutting portions in communication with the plurality of first pivotal portions, respectively, with the plurality of first abutting portions in a same number as the plurality of first pivotal portions, wherein each first abutting portion extends to form a second abutting portion communicating with a corresponding one of the plurality of first abutting portions and a corresponding one of the plurality of first pivotal portions, wherein each second abutting portion is an upright opening, and wherein each first abutting portion is an oblique opening defined by a first angle;

a plurality of support rods in a same number as the plurality of first pivotal portions of the base member, with the plurality of support rods abutting against the plurality of first abutting portions of the base member, respectively, and crossing each other in a radiating manner, with the plurality of support rods resting on a plane or ground and each having a second pivotal portion and a first coupling portion disposed above the second pivotal portion, with the second pivotal portions facing and matching the plurality of first pivotal portions, respectively, and connecting pivotally to the plurality of first pivotal portions, respectively, with each second pivotal portion being a through round hole, wherein the plurality of support rods is rotatable about the plurality of first pivotal portions, respectively, wherein a second coupling portion is disposed at a top end of each support rod, wherein each first coupling portion is disposed between a corresponding one of the second coupling portions and a corresponding one of the plurality of first pivotal portions;

a bag for containing therein the plurality of balls, wherein a plurality of third coupling portions is disposed at the bag, coupled to and engaged with the second coupling portions, respectively, with the bag mounted on the plurality of support rods;

a cord having a plurality of fourth coupling portions coupled to the first coupling portions of the plurality of support rods, respectively, with the cord in contact with a bottom of the bag to allow a weight of the bag to be borne by the second coupling portions of the plurality of support rods and the cord, with the cord adapted to be pulled by a user to rotate the plurality of support rods about the plurality of first pivotal portions of the base member and abut against the second abutting portions of the base member, respectively, thereby allowing the plurality of support rods to collapse as a whole; and a plurality of pivotal elements for connecting pivotally the plurality of first pivotal portions of the base member to the second pivotal portions of the plurality of support rods, respectively, wherein the plurality of pivotal elements corresponds in quantity to the plurality of first pivotal portions of the base member.

2. The ball storage rack structure of claim 1, wherein the plurality of first pivotal portions is in a number of four and circumferentially arranged on an outer circumferential surface of the base member, with the plurality of first abutting portions in a number of four, with the second abutting portions in a number of four, and with the plurality of support rods in a number of four, wherein the plurality of third coupling portions of the bag is in a number of four, wherein the bag is a net bag structure, wherein the cord is in a form of a cruciform structure, and wherein the plurality of pivotal elements is in a number of four.

3. The ball storage rack structure of claim 1, wherein a portion of each first pivotal portion is near an outer circumferential surface of the base member and has an internal thread, and wherein each pivotal element has a thread portion provided with an external thread, with each pivotal element screwed to a corresponding one of the plurality of first pivotal portions.

4. The ball storage rack structure of claim 1, wherein a first raised portion is disposed between the first abutting portion and the second abutting portion and positioned proximate to the first pivotal portion, wherein the plurality of support rods is confined to abut against the second abutting portions of the base member, respectively, wherein the second abutting portions are upright openings, wherein the plurality of support rods is engaged with the first raised portions in the second abutting portions, respectively, wherein the plurality of support rods is confined to the first raised portions with the plurality of support rods prevented from moving back to the plurality of first abutting portions.

5. The ball storage rack structure of claim 1, wherein each first coupling portion of a corresponding one of the plurality of support rods is a through round hole.

6. The ball storage rack structure of claim 1, wherein each second coupling portion is a hook structure, and wherein each support rod is substantially S-shaped lengthwise and is round in cross-section.

7. The ball storage rack structure of claim 1, further comprising a plurality of rollers disposed at bottom ends of the plurality of support rods, respectively.

8. The ball storage rack structure of claim 1, further comprising a snap-engagement unit with an end fixed to one of the plurality of support rods and another end fixed to another adjacent support rod, and wherein two ends of the snap-engagement unit are above and below the plurality of first pivotal portions of the base member, respectively.

9. The ball storage rack structure of claim 8, wherein the snap-engagement unit is a male-female engaging structure and has a male engaging portion and a female engaging portion, wherein the male engaging portion and the female engaging portion are coupled to and engaged with each other, wherein a free end of the male engaging portion and a free end of the female engaging portion are each connected to the plurality of support rods, respectively, through a fixing cord, wherein a sum of a length of the male engaging portion and a length of the fixing cord thereof is larger than a sum of a length of the female engaging portion and a length of the fixing cord thereof.

10. The ball storage rack structure of claim 1, further comprising a fixing unit having a plurality of receiving members, wherein each receiving member is of a same width as each support rod, wherein the plurality of support rods is confined to the receiving members, respectively, wherein the receiving members each have a second raised portion positioned proximate to an opening of the receiving member, with each second raised portion engaged with a corresponding one of the plurality of support rods to thereby prevent the plurality of support rods from escaping from the receiving members.

11. The ball storage rack structure of claim 1, wherein a first fitting portion is disposed centrally at the base member, wherein the first fitting portion is penetrable and not round in cross-section, wherein a fixing assembly comprising a fixing bar and a fixing unit is provided, wherein the fixing bar corresponds in shape to the first fitting portion of the base member and is coupled to the base member, wherein the fixing unit is coupled to another end of the fixing bar and has a plurality of receiving members, wherein each receiving member is of a same width as each support rod, wherein the plurality of support rods is confined to the plurality of receiving members, respectively, and wherein the plurality of receiving members each have a second raised portion positioned proximate to an opening of the receiving member, with each second raised portion engaged with a corresponding one of the plurality of support rods, thereby preventing the plurality of support rods from escaping from the plurality of receiving members.

12. The ball storage rack structure of claim 11, wherein the first fitting portion is in communication with the plurality of first pivotal portions, wherein a first coupling hole is disposed at an end of the fixing bar and faces a corresponding one of the plurality of first pivotal portions of the base member, and wherein the plurality of pivotal elements passes through the plurality of first pivotal portions, respectively, with the plurality of pivotal elements confined to the first coupling hole, thereby allowing the fixing bar to be coupled to the base member.

13. The ball storage rack structure of claim 11, wherein a plurality of engaging slots is disposed at another end of the fixing bar, wherein a second fitting portion is disposed centrally at the fixing unit, wherein the second fitting portion is of a same shape as the fixing bar, wherein two recesses are disposed on two opposing sides of the second fitting portion, respectively, wherein the two recesses each match and face a corresponding one of the plurality of engaging slots of the fixing bar, wherein the fixing unit has a substantially swastika shape, wherein the fixing assembly has an engaging unit with at least one engaging portion protruding from the engaging unit, wherein the at least one engaging portion fits inside the fixing bar and is coupled to and engaged with the plurality of engaging slots of the fixing bar, respectively, wherein the at least one engaging portion is engaged with bottoms of the two recesses of the fixing unit, respectively, with the engaging unit coupling the fixing bar and the fixing unit to each other.

14. The ball storage rack structure of claim 11, wherein the first fitting portion is quadrilateral, wherein the fixing bar has a quadrilateral cross-section, wherein the first coupling hole is a through round hole, with the plurality of engaging slots in a number of two, wherein the plurality of engaging slots is disposed on opposing sides of the fixing bar, respectively, with each engaging slot being penetrable and oblong, wherein the fixing bar has a hollow core, wherein two recesses are disposed on two opposing sides of the second fitting portion, respectively, wherein the two recesses each match and face a corresponding one of the plurality of engaging slots of the fixing bar, and wherein the fixing unit has a substantially swastika shape.

15. The ball storage rack structure of claim 1, further comprising a plurality of blind rivet structures and an eyelet rivet structure, with the plurality of blind rivet structures coupling the plurality of fourth coupling portions of the cord to the plurality of first coupling portions of the plurality of support rods, respectively, with the plurality of blind rivet structures in a number of four, wherein the cord consists substantially of two slender cord elements which cross each other to render the cord into a form of a cruciform structure, and wherein an eyelet rivet structure is disposed at a central junction of the cruciform structure of the cord.

16. The ball storage rack structure of claim 1, wherein a penetrable hole having an internal thread is disposed centrally at the base member, wherein a portion having an external thread is disposed at an end of a support element, with the portion screwed to the penetrable hole, wherein the support element supports the cord, and wherein a weight of the bag is borne by the plurality of support rods, the cord, and the support element.

17. A ball storage rack structure, comprising:

a base member having a plurality of first pivotal portions and a plurality of first abutting portions, with the plurality of first pivotal portions in a number of at least three, with the plurality of first abutting portions in communication with the plurality of first pivotal portions, respectively, with the plurality of first abutting portions in a same number as the plurality of first pivotal portions, with each first abutting portion being an oblique opening defined by a first angle;

a plurality of support rods in a same number as the plurality of first pivotal portions of the base member, with the plurality of support rods abutting against the plurality of first abutting portions of the base member, respectively, and crossing each other in a radiating manner, with the plurality of support rods resting on a plane or ground and each having a second pivotal portion facing and matching a corresponding one of the plurality of first pivotal portions, with the second pivotal portions connecting pivotally to the plurality of first pivotal portions, respectively, wherein each support rod has a first coupling portion positioned above the second pivotal portion, with a second coupling portion disposed at a top end of each support rod, wherein the first coupling portion is disposed between the second coupling portion and the first pivotal portion; and a plurality of pivotal elements for connecting pivotally the plurality of first pivotal portions of the base member to the second pivotal portions of the plurality of support rods, respectively, wherein the plurality of pivotal elements corresponds in quantity to the plurality of first pivotal portions of the base member.

18. The ball storage rack structure of claim 17, wherein each first abutting portion extends to form a second abutting portion communicating with a corresponding one of the plurality of first abutting portions and a corresponding one of the plurality of first pivotal portions, with each second abutting portion being an upright opening, wherein the second pivotal portions of the plurality of support rods are pivotally connected to the plurality of first pivotal portions of the base member, respectively, with each support rod rotatable about a corresponding one of the plurality of first pivotal portions, and wherein each second pivotal portion is a through round hole.

19. The ball storage rack structure of claim 18, wherein the plurality of support rods supports a bag adapted to contain therein a plurality of balls, and wherein the bag has a plurality of third coupling portions, with each third coupling portion coupled to and engaged with a corresponding one of the second coupling portions, and with the bag mounted on the plurality of support rods.

20. The ball storage rack structure of claim 19, wherein the plurality of support rods is coupled to a cord having a plurality of fourth coupling portions coupled to the plurality of first coupling portions of the plurality of support rods, respectively, with the cord in contact with a bottom of the bag with a weight of the bag borne by the second coupling portions of the plurality of support rods and the cord, wherein the cord is adapted to be pulled by a user to rotate the plurality of support rods about the plurality of first pivotal portions of the base member, respectively, and abut against the second abutting portions, respectively, thereby collapsing the plurality of support rods as a whole.

* * * * *